US011174580B2

(12) United States Patent
Ryu et al.

(10) Patent No.: US 11,174,580 B2
(45) Date of Patent: Nov. 16, 2021

(54) WASHING MACHINE

(71) Applicant: Samsung Electronics Co., Ltd., Suwon-si (KR)

(72) Inventors: Myung-Hee Ryu, Suwon-si (KR); Yongjie Jin, Suwon-si (KR); Yong-Kwon Kim, Yongin-si (KR); Sang Up Lee, Yongin-si (KR); Sang Yeon Pyo, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 277 days.

(21) Appl. No.: 16/323,105

(22) PCT Filed: Jul. 11, 2017

(86) PCT No.: PCT/KR2017/007406
§ 371 (c)(1),
(2) Date: Feb. 4, 2019

(87) PCT Pub. No.: WO2018/026112
PCT Pub. Date: Feb. 8, 2018

(65) Prior Publication Data

US 2019/0203397 A1 Jul. 4, 2019

(30) Foreign Application Priority Data

Aug. 4, 2016 (KR) ..... 10-2016-0099431

(51) Int. Cl.

| | |
|---|---|
| ***D06F 37/16*** | (2006.01) |
| ***D06F 29/00*** | (2006.01) |
| ***D06F 37/18*** | (2006.01) |
| ***D06F 37/26*** | (2006.01) |
| ***D06F 39/08*** | (2006.01) |
| ***D06F 37/12*** | (2006.01) |
| ***D06F 37/42*** | (2006.01) |

(Continued)

(52) U.S. Cl.
CPC ..... *D06F 37/16* (2013.01); *D06F 29/00* (2013.01); *D06F 37/12* (2013.01); *D06F 37/18* (2013.01);

(Continued)

(58) Field of Classification Search
CPC ..... D06F 37/16; D06F 39/08; D06F 39/12; D06F 29/00; D06F 37/18; D06F 37/42;

(Continued)

(56) References Cited

U.S. PATENT DOCUMENTS

2015/0184326 A1* 7/2015 Seo ..... D06F 37/20 68/132
2015/0211163 A1* 7/2015 Kim ..... D06F 17/10 68/133

(Continued)

FOREIGN PATENT DOCUMENTS

KR 20-2000-0015280 3/2000
KR 20-2000-0018236 10/2000

(Continued)

OTHER PUBLICATIONS

International Search Report dated Sep. 22, 2017 in International Patent Application No. PCT/KR2017/007406.

(Continued)

*Primary Examiner* — Benjamin L Osterhout
(74) *Attorney, Agent, or Firm* — Staas & Halsey, LLP

(57) ABSTRACT

Provided is a washing machine capable of preventing laundry in a rotary tub from having pigment transfer or contamination due to wash water of an auxiliary washing tub. The washing machine includes a cabinet, a tub located in the cabinet and storing wash water therein, a main washing tub rotatably disposed in the tub and having a first washing (Continued)

space, and an auxiliary washing tub detachably mounted to the main washing tub and having a second washing space, wherein the auxiliary washing tub includes a drain path for guiding wash water of the second washing space to a space between the tub and the main washing tub.

7 Claims, 15 Drawing Sheets

(51) Int. Cl.
*D06F 39/12* (2006.01)
*D06F 37/24* (2006.01)

(52) U.S. Cl.
CPC ..... *D06F 37/24* (2013.01); *D06F 37/26* (2013.01); *D06F 37/267* (2013.01); *D06F 37/42* (2013.01); *D06F 39/08* (2013.01); *D06F 39/12* (2013.01)

(58) Field of Classification Search
CPC ..... D06F 37/267; D06F 37/24; D06F 37/12; D06F 37/26
See application file for complete search history.

(56) References Cited

U.S. PATENT DOCUMENTS

| | | | | |
|---|---|---|---|---|
| 2015/0275412 | A1* | 10/2015 | Kim | D06F 37/18 68/27 |
| 2016/0230326 | A1* | 8/2016 | Han | D06F 31/00 |
| 2017/0167069 | A1* | 6/2017 | Choi | D06F 39/088 |
| 2018/0119327 | A1* | 5/2018 | Kim | D06F 37/26 |
| 2019/0177900 | A1* | 6/2019 | Kwon | D06F 37/302 |

FOREIGN PATENT DOCUMENTS

| | | |
|---|---|---|
| KR | 10-2003-0045447 | 6/2003 |
| KR | 10-2007-0017732 | 2/2007 |

OTHER PUBLICATIONS

Written Opinion of the International Searching Authority dated Sep. 22, 2017 in International Patent Application No. PCT/KR2017/007406.

* cited by examiner

WASHING MACHINE

CROSS-REFERENCE TO RELATED APPLICATION

This application is a U.S. national stage application, which claims the benefit under 35 USC § 371 of PCT International Patent Application No. PCT/KR2017/007406, filed on Jul. 11, 2017, which claims the foreign priority benefit of Korean Patent Application No. 10-2016-0099431, filed on Aug. 4, 2016 in the Korean Patent and Trademark Office, the disclosures of which are hereby incorporated by reference in their entirety.

TECHNICAL FIELD

The present disclosure relates to a washing machine, and more specifically, to a washing machine including an auxiliary washing tub located at an inside of a rotary tub.

BACKGROUND ART

A washing machine refers to a machine that washes clothing using electric power, and is generally divided into a full-automatic type washing machine that washes laundry by stirring the laundry together with wash water and generating a wash current through rotation of a pulsator, and a drum-type washing machine that washes laundry by dropping the laundry using a lifter formed on a drum.

The full-automatic type washing machine includes a tub for storing wash water, a rotary tub rotatably installed in the tub, a pulsator rotatably installed on the bottom of the rotary tub, and a driving device for rotationally driving the rotary tub and the pulsator.

When the rotary tub and the pulsator rotate while laundry and wash water are introduced into the rotary tub, the pulsator stirs the laundry introduced into the rotary tub together with the wash water to remove dirt on the laundry.

In recent years, an auxiliary washing tub is provided in the rotary tub, so that the laundry may be separated and individually washed. Since the auxiliary washing tub allows separate washing on the basis of the type of laundry, consumers are provided with enhanced efficiency in terms of time and finance in using washing machines.

Meanwhile, when the wash water of the auxiliary washing tub is drained to the rotary tub, the laundry in the rotary the laundry in the rotary tub have pigment transfer or contamination due to the wash water of the auxiliary washing tub.

DISCLOSURE

Technical Problem

The present disclosure is directed to providing a washing machine capable of preventing laundry in a rotary tub from having pigment transfer or contamination due to wash water of an auxiliary washing tub.

The present disclosure is directed to providing a washing machine including a drain path for guiding wash water of an auxiliary washing tub to the outside of a rotary tub.

The present disclosure is directed to providing a washing machine capable of preventing wash water of an auxiliary washing tub from escaping to the outside of the auxiliary washing tub during a washing operation.

The present disclosure is directed to providing a washing machine capable of selectively opening and closing a drain hole of an auxiliary washing tub according to a rotational speed of an auxiliary washing tub.

Technical Solution

One aspect of the present disclosure provides a washing machine including: a cabinet; a tub located in the cabinet and storing wash water therein; a main washing tub rotatably disposed in the tub and having a first washing space; and an auxiliary washing tub detachably mounted to the main washing tub and having a second washing space, wherein the auxiliary washing tub includes a drain path for guiding wash water of the second washing space to a space between the tub and the main washing tub.

The auxiliary washing tub may include: a basket portion including a bottom wall, a sidewall extending upward from the bottom wall to form the second washing space, and a seating portion radially outwardly extending from the sidewall to be seated on an upper side of the main washing tub; and a cover portion provided at an upper side of the basket portion and having a laundry inlet.

The drain path may be formed by the seating portion and the cover portion.

The cover portion may include a first partition wall extending toward the sidewall and having a first drain groove, and the first partition wall may form a first drain hole together with the sidewall.

The seating portion may include a second partition wall extending toward the cover portion and having a second drain groove, and the second partition wall may form a second drain hole together with the cover portion.

The first drain hole and the second drain hole may be located to be higher than an upper end of the main washing tub.

The cover portion may further include an inner cover portion that guides wash water in the basket portion to the first drain hole and an outer cover portion that guides wash water having passed through the first drain hole and the second drain hole to an outside of the main washing tub together with the seating portion.

The inner cover portion may extend toward an inside of the basket portion, and the outer cover portion may extend toward an outside of the basket portion and may be bent downward.

Wash water in the auxiliary washing tub may be introduced into the first drain hole along the sidewall when the auxiliary washing tub rotates at a predetermined rotational speed or above, and the wash water introduced into the first drain hole may be introduced into the second drain hole by the first partition wall and the second partition wall, and the wash water introduced into the second drain hole may be guided to the outside of the main washing tub by the seating portion and the cover portion.

The auxiliary washing tub may be formed of deformable material, have a ring shape, and further include a drain path opening and closing member to open or close the drain path depending on a rotational speed of the auxiliary washing tub.

Another aspect of the present disclosure provides a washing machine including: a cabinet; a tub located in the cabinet and storing wash water therein; a main washing tub disposed in the tub and having a first washing space; a balancer located at an upper side of the main washing tub, and an auxiliary washing tub detachably mounted to the balancer and having a second washing space, wherein the auxiliary washing tub includes a drain path for guiding wash water of the second washing space to an upper side of the balancer.

The auxiliary washing tub may include a seating portion to be seated on the balancer and a cover portion provided on an upper side of the seating portion to from the drain path.

The auxiliary washing tub may include a drain hole to drain wash water of the second washing space, and the drain hole is located to be higher than an upper end of the balancer.

The auxiliary washing tub may include a drain hole opening and closing member to open or close the drain hole depending on a rotational speed of the auxiliary washing tub.

The drain hole opening and closing member may be formed of deformable material, and when the auxiliary washing tub rotates at a predetermined speed or above, the drain hole opening and closing member may be deformed to thereby open the drain hole.

The drain hole opening and closing member may include an elastic member, and when the auxiliary washing tub rotates at a predetermined speed or above, the elastic member is elastically deformed so that the drain hole opening and closing member opens the drain hole.

The drain hole opening and closing member may include a magnet member disposed on one side of the drain hole, the drain hole opening and closing member may be formed of a metal material and may be disposed on the other side of the drain hole.

The balancer may include an opening allowing laundry to be introduced into the main washing tub and a supporting rib extending upward along a periphery of the opening to support the auxiliary washing tub.

The supporting rib may prevent wash water guided by the drain path from being introduced into the main washing tub.

Another aspect of the present disclosure provides a washing machine including: a cabinet; a tub located in the cabinet and storing wash water therein; a main washing tub rotatably disposed in the tub; a balancer located at an upper side of the main washing tub, and an auxiliary washing tub detachably mounted to the balancer and having a drain hole, wherein the drain hole is located to be higher than an upper end of the balancer such that wash water having passed through the drain hole is guided to an upper side of the balancer.

Advantageous Effects

One aspect of the present disclosure provides a washing machine capable of preventing laundry in a rotary tub from having pigment transfer or contamination due to wash water of an auxiliary washing tub.

Another aspect of the present disclosure provides a washing machine including a drain path for guiding wash water of an auxiliary washing tub to the outside of a rotary tub.

Another aspect of the present disclosure provides a washing machine capable of preventing wash water of an auxiliary washing tub from escaping to the outside of the auxiliary washing tub during a washing operation.

Another aspect of the present disclosure provides a washing machine capable of selectively opening and closing a drain hole of an auxiliary washing tub according to a rotational speed of an auxiliary washing tub.

MODES OF THE INVENTION

Hereinafter, embodiments of the present disclosure will be described in detail with reference to the accompanying drawings.

Figure 1:
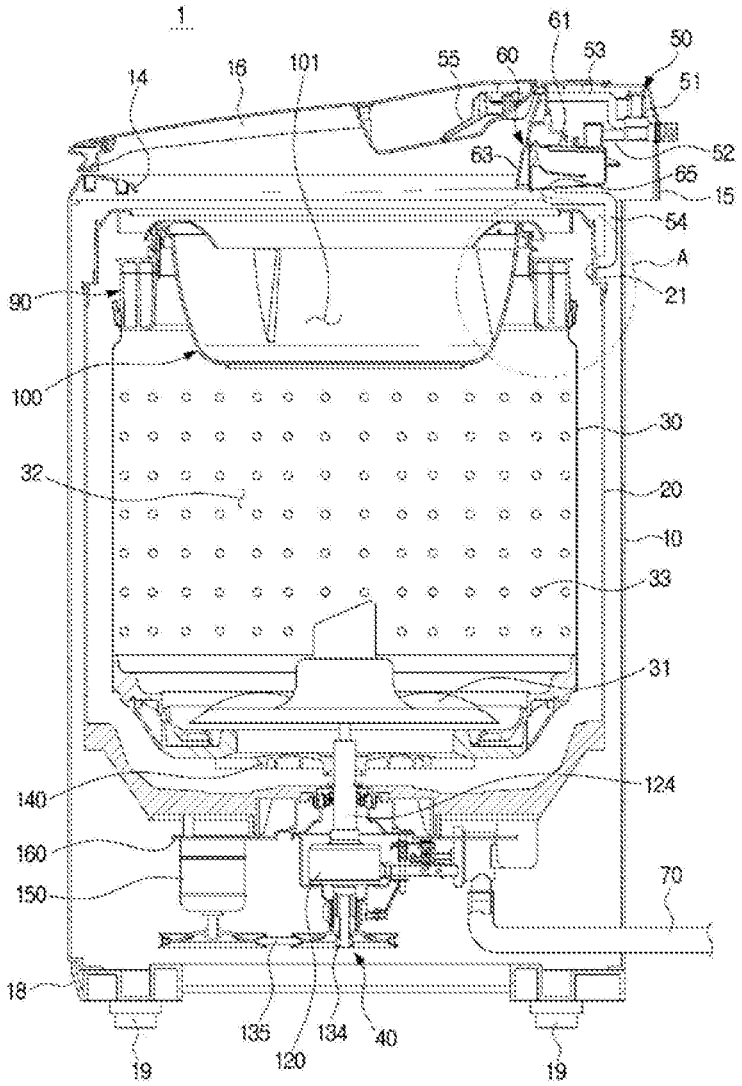
FIG. 1 is a sectional view illustrating a washing machine according to an embodiment of the present disclosure.

FIG. 1 is a view illustrating a washing machine according to an embodiment of the present disclosure.

Referring to FIG. 1, the washing machine 1 includes a cabinet 10 forming the external appearance of the washing machine 1, a tub 20 located inside the cabinet and storing wash water therein, a main washing tub 30 rotatably disposed inside the tub 20, and a driving device 40 for rotating the main washing tub 30.

The cabinet 10 may include an upper cover 15 and a lower cover 18.

The upper cover 15 may be provided with an inlet 14 that allows laundry to be introduced into the main washing tub 30 therethrough. The upper cover 15 may be provided with a door 16 for opening and closing the inlet 14.

The lower cover 18 may be coupled to a grounding portion 19 that is configured to fix the washing machine 1 to the floor surface.

A water supply device 50 for supplying wash water to the main washing tub 30 and the auxiliary washing tub 100 may be installed at an upper side of the cabinet 10.

The tub 20 may be disposed inside the cabinet 10 to store wash water therein. The tub 20 may be supported in the cabinet 10 by a suspension member (not shown). A water supply hole 21 may be formed in an upper portion of the tub 20.

The main washing tub 30 may be rotatably disposed inside the tub 20. The main washing tub 30 may have a first washing space 32 therein. A pulsator 31 may be rotatably installed on the bottom of the main washing tub 30. The pulsator 31 may stir the laundry that has been introduced into the main washing tub 30 together with wash water. That is, the pulsator 31 may stir the laundry in the first washing space 32 together with wash water.

A plurality of through holes 33 may be formed on an outer surface of the main washing tub 30. Wash water may be introduced and discharged between the main washing tub 30 and the tub 20 through the through holes 33.

A balancer 90 may be provided on an upper side of the main washing tub 30. The balancer 90 may include a connecting hole 94. The balancer 90 may be coupled to the upper portion of the main washing tub 30 as the connecting hole 94 is connected to a connecting member (not shown).

The auxiliary washing tub 100 may have a second washing space 101. The auxiliary washing tub 100 may be detachably mounted to the main washing tub 30. In detail, the auxiliary washing tub 100 may be detachably mounted to the balancer 90 coupled to the upper portion of the main washing tub 30. Hereinafter, mounting the auxiliary washing tub 100 to the main washing tub 30 is referred to as both seating the auxiliary washing tub 100 on the main washing tub 30 and coupling the auxiliary washing tub 100 to the main washing tub 30.

When the auxiliary washing tub 100 is mounted to the main washing tub 30, the auxiliary washing tub 100 may rotate together with the main washing tub 30. In this case, the auxiliary washing tub 100 may wash laundry in the second washing space 101 separately from laundry in the first washing space 32.

When the auxiliary washing tub 100 is detached from the main washing tub 30, the auxiliary washing tub 100 may be used as a laundry container for accommodating laundry before and after a washing operation.

A water supply device 50 for supplying wash water to the main washing tub 30 and the auxiliary washing tub 100 may be installed on the cabinet 10.

The water supply device 50 includes a water supply valve 51 for controlling water supply, a first water supply pipe 52 connecting the water supply valve 51 to a detergent supply device 60, a second water supply pipe 53 connecting the water supply valve 51 to an injection nozzle 55 for injecting wash water to the upper portion of the auxiliary washing tub 100, and a third water supply pipe 54 connecting the detergent supply device 60 to the water supply hole 21 provided in the tub 20.

One side of the water supply valve 51 may be connected to an external water supply source (not shown), and the other side of the water supply valve 51 may be connected to the first water supply pipe 52 and the second water supply pipe 53.

One side of the first water supply pipe 52 may be connected to the water supply valve 51 and the other side of the first water supply pipe 52 may be connected to the detergent supply device 60. Accordingly, the first water supply pipe 52 may supply wash water to the detergent supply device 60.

One side of the second water supply pipe 53 may be connected to the water supply valve 51 and the other side of the second water supply pipe 53 may be connected to the injection nozzle 55. The injection nozzle 55 may be disposed at an upper side of the auxiliary washing tub 100. The injection nozzle 55 may supply wash water to the auxiliary washing tub 100.

One side of the third water supply pipe 54 may be connected to the detergent supply device 60 and the other side of the third water supply pipe 54 may be connected to the water supply hole 21 formed on the outer surface of the tub 20. The third water supply pipe 54 may supply the wash water with detergent dissolved through the detergent supply device 60 to the space between the tub 20 and the main washing tub 30. The wash water supplied into the tub 20 by the third water supply pipe 54 may be stored in the main washing tub 30 through the through holes 33.

The detergent supply device 60 may be disposed inside the upper cover 15. The detergent supply device 60 may include a case 63 connected to the first water supply pipe 52 and a detergent container 61 detachably mounted to the case 63 and capable of accommodating various types of detergent. A discharge port 65 for discharging wash water in which detergent is dissolved may be formed on the bottom surface of the case 63. The third water supply pipe 54 may be connected to the discharge port 65. Water supplied through the first water supply pipe 52 may be supplied to the space between the main washing tub 30 and the tub 20 together with the detergent via the detergent supply device 60 and the third water supply pipe 54.

A drain hose 70 may be provided at a lower side of the tub 20 to drain the wash water to the outside of the cabinet 10 after the washing or dehydrating process is completed.

The driving device 40 includes a clutch 120 that selectively rotates the main washing tub 30 and the pulsator 31, a driving motor 150 that drives the clutch 120, a flange member 140 that connects a driving shaft 124 of the clutch 120 to a bottom portion of the main washing tub 30 to transmit the rotational force of the driving shaft 124 to the main washing tub 30, and a base plate 160 that fixes the clutch 120 and the driving motor 150. In addition, the driving device 40 may include a pulley 135 for fixing the clutch 120 and the driving motor 150.

Figure 2:
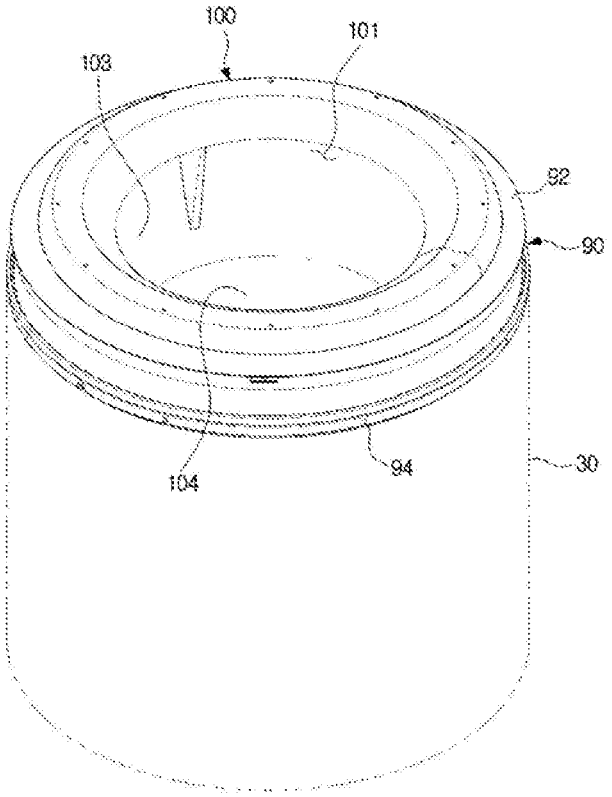
FIG. 2 is a view illustrating a state in which an auxiliary washing tub is mounted to a balancer in the washing machine according to the embodiment of the present disclosure.
Figure 3:
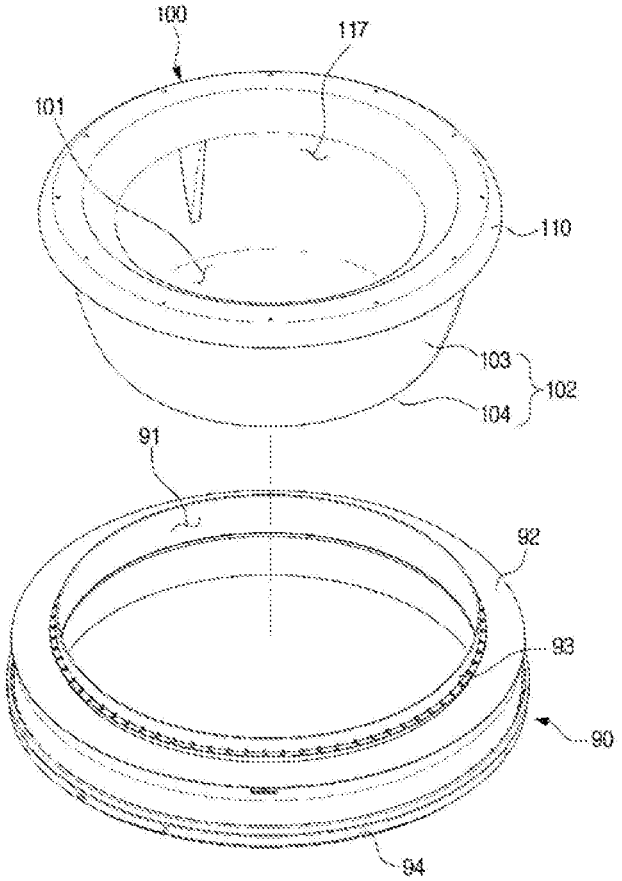
FIG. 3 is a view illustrating a state in which the auxiliary washing tub and the balancer shown in FIG. 2 are separated from each other.

FIG. 2 is a view illustrating a state in which the auxiliary washing tub is mounted on the balancer in the washing machine according to the embodiment of the present disclosure, and FIG. 3 is a view illustrating a state in which the auxiliary washing tub and the balancer shown in FIG. 2 are separated from each other.

Referring to FIGS. 2 and 3, the auxiliary washing tub 100 may be detachably mounted to the balancer 90 disposed on the upper side of the main washing tub 30. A user may mount the auxiliary washing tub 100 to the main washing tub 30 when a separate washing is desired. The auxiliary washing tub 100 may perform separate washing on laundry when the laundry is inappropriate to be washed together with laundry in the main washing tub 30 due to a concern over a pigment transfer or the like. That is, the main washing tub 30 may perform washing in the first washing space 32, and the auxiliary washing tub 100 may perform washing in the second washing space 101.

However, even when the separate washing is performed on laundry through the main washing tub 30 and the auxiliary washing tub 100, when wash water of the auxiliary washing tub 100 is drained into the main washing tub 30 during a dehydrating operation, laundry in the main washing tub 300 may be subjected to contamination or pigment transfer. In order to prevent the laundry from having contamination or pigment transfer, the auxiliary washing tub and the washing machine having the same according to an aspect of the present disclosure may include a drain path for guiding wash water of the auxiliary washing tub to the space between the main washing tub and the tub. Since the wash water is immediately drained to the outside of the main washing tub during the dehydrating operation of the auxiliary washing tub, laundry of the main washing tub is not subjected to pigment transfer or contamination due to the wash water of the auxiliary washing tub.

Figure 4:
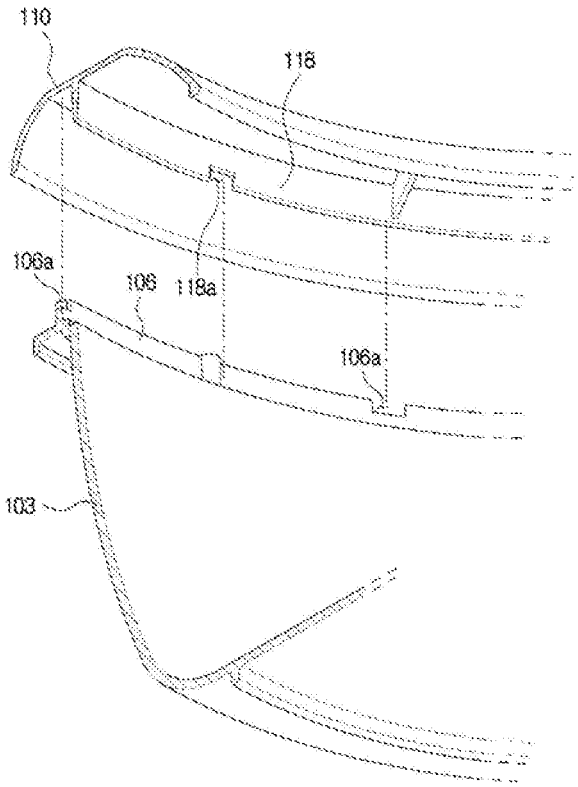
FIG. 4 is an exploded view illustrating the auxiliary washing tub of the washing machine according to the embodiment of the present disclosure.
Figure 5:
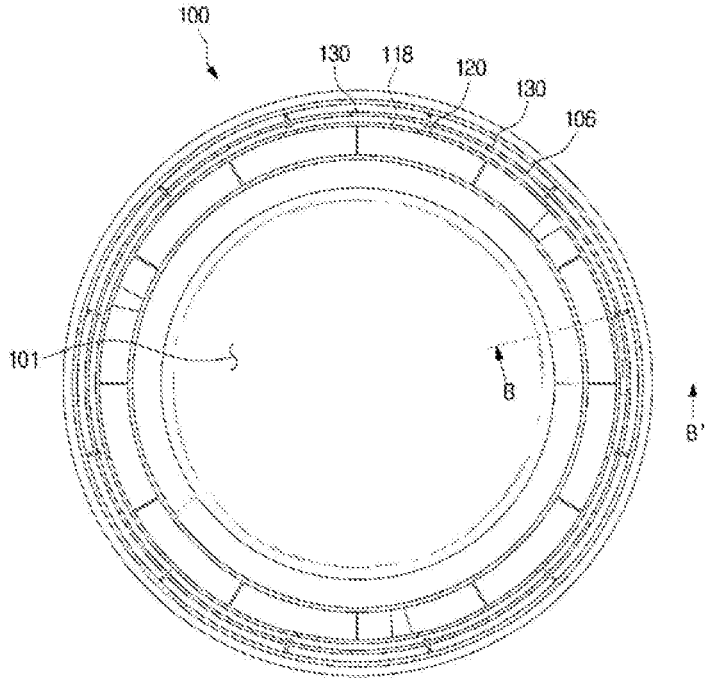
FIG. 5 is a cross-sectional view illustrating the auxiliary washing tub of the washing machine according to the embodiment of the present disclosure.
Figure 6:
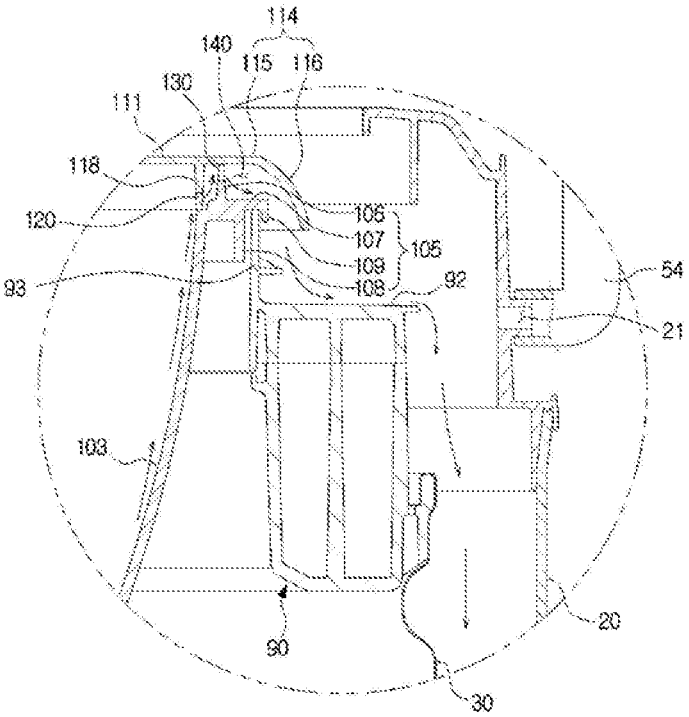
FIG. 6 is a cross-sectional view taken along line B-B' of the auxiliary washing tub shown in FIG. 5.

FIG. 4 is an exploded view illustrating the auxiliary washing tub of the washing machine according to the embodiment of the present disclosure, FIG. 5 is a cross-sectional view illustrating the auxiliary washing tub of the washing machine according to the embodiment of the present disclosure, and FIG. 6 is a cross-sectional view taken along line B-B' of the auxiliary washing tub shown in FIG. 5.

Referring to FIGS. 4 to 6, the auxiliary washing tub 100 may include a basket portion 102 forming the second washing space 101 and a cover portion 110 forming a laundry inlet 117.

The basket portion 102 may include a bottom wall 104 and a sidewall 103. The sidewall 103 may be formed to be inclined outward with respect to the bottom wall 104 to guide wash water to a first drain hole 120 by a centrifugal force. Accordingly, the cross-sectional area of the basket portion 102 may become larger as being directed upward. The sidewall 103 is inclined so that the wash water in the auxiliary washing tub 100 may move to the upper side of the sidewall 103 when the auxiliary washing tub 100 is rotated. That is, the wash water moves to the sidewall 103 by the centrifugal force, and the wash water moved to the sidewall 103 moves to the upper side of the sidewall 103 along the inclination of the sidewall 103. Since the first drain hole 120 is formed in an upper portion of the sidewall 103, the wash water having passed through the first drain hole 120 may be drained through a drain path 140 which will be described below.

The basket portion 102 may further include a seating portion 105 that is seated on the upper end of the main washing tub 30. The seating portion 105 may extend outwardly from the sidewall 103. The seating portion 105 may be formed on the upper side of the sidewall 103. That is, the seating portion 105 may refer to an outer edge portion formed on the upper side of the basket portion 120.

The seating portion 105 includes a horizontal portion 107 extending horizontally from the sidewall 103 and first and second vertical portions 108 and 109 extending downward from the horizontal portion 107. The horizontal portion 107 may be provided substantially horizontal with respect to the bottom wall 104. The horizontal portion 107 may have a ring shape. The first vertical portion 108, the second vertical portion 109, and the horizontal portion 107 may form a fitting groove 109*a* into which the balancer 90 is fitted. A supporting rib 93 of the balancer 90 may be fitted into the fitting groove 109*a*. The supporting rib 93 of the balancer 90 is fitted into the fitting groove 109*a* so that the auxiliary washing tub 100 may be seated on the upper end of the main washing tub 30.

The seating portion 105 may include a second partition wall 106 forming a second drain hole 130 together with the cover portion 110. The second partition wall 106 may extend upward from the horizontal portion 107. The second partition wall 106 will be described below.

The cover portion 110 may be disposed at the upper side of the basket portion 102. The cover portion 110 may include an inner cover portion 111, an outer cover portion 114, and a first partition wall 118.

The first partition wall 118 may be formed on a lower surface of the cover portion 110. The first partition wall 118 may extend downward from the lower surface of the cover portion 110.

The first partition wall 118 may include a first drain groove 118*a*. The first drain groove 118*a* may be formed by cutting out a part of the first partition wall 118. The first drain groove 118*a* may be formed in a substantially rectangular shape at a lower end of the first partition wall 118. The first drain grooves 118*a* may be formed to be spaced apart from each other in the circumferential direction of the first partition wall 118.

The first drain groove 118*a* may be provided in various shapes. According to one embodiment of the present disclosure, the first drain groove 118*a* may have a substantially rectangular shape, but is not limited thereto. For example, the first drain groove 118*a* may be formed in a shape of a circle passing through the first partition wall 118.

The cover portion 110 may form the first drain hole 120 together with the sidewall 103. The first partition wall 118 may be arranged to be in contact with an upper end of the sidewall 103. When the first partition wall 118 and the sidewall 103 are in contact with each other, the first drain groove 118*a* may form the first drain hole 120. That is, when the cover portion 110 is coupled to the basket portion 102, the cover portion 110 and the sidewall 103 may form the first drain hole 120. In this case, a portion of the first partition wall 118 except for the first drain groove 118*a* may prevent wash water from escaping to the outside of the auxiliary washing tub 100 together with the sidewall 103.

The cover portion 110 may include the inner cover portion 111 extending to the inside of the basket portion 102. The inner cover portion 111 may refer to a portion of the cover portion 110 extending inward of the basket portion 102 with respect to the first partition wall 118. The inner cover portion 111 extends horizontally from the first partition wall 118 toward the inside of the basket portion 102 and is bent downward.

The inner cover portion 111 may include an inner horizontal portion 112 and an inner bent portion 113. The inner horizontal portion 112 may refer to a portion of the inner cover portion 111 that horizontally extends. The inner bent portion 113 may refer to a portion bent at one end of the inner horizontal portion 112. One end of the inner bent portion 113 may be connected to the inner horizontal portion 112, and the other end of the inner bent portion 113 may form the laundry inlet 117.

The inner cover portion 111 may guide the wash water in the auxiliary washing tub 100 to be introduced into the first drain hole 120. When the wash water in the auxiliary washing tub 100 moves toward the first drain hole 120, the inner cover portion 111 may prevent the wash water from escaping to the upper side of the auxiliary washing tub 100. The wash water is prevented from escaping to the upper side of the auxiliary washing tub 100 by the first partition wall 118 and the inner cover portion 111, and is introduced into the first drain hole 120. That is, the inner cover portion 111 allows the wash water to be guided to the first drain hole 120 instead of escaping to the upper side of the auxiliary washing tub 100.

The cover portion 110 may include the outer cover portion 114 extending to the outside of the basket portion 102. The outer cover portion 114 may refer to a portion of the cover portion 110 extending from the first partition wall 118 to the outside of the basket portion 102. The outer cover portion 114 extends horizontally from the first partition wall 118 to the outside of the basket part 102 and is bent downward. The outer cover portion 114 may cover the upper side of the seating portion 105.

The outer cover portion 114 may include an outer horizontal portion 115 and an outer bent portion 116. The outer horizontal portion 115 may refer to a portion extending horizontally from the first partition wall 118 to the outside of the basket portion 102. The outer bent portion 116 may refer to a portion bent downward at one end of the outer horizontal portion 115.

The seating part 105 may include the second partition wall 106. The second partition wall 106 may extend upward from the horizontal portion 107 to support the outer cover portion 114. The second partition wall 106 may include a second drain groove 106*a*. The second drain groove 106*a* may be formed by cutting out a part of the second partition wall 106. The second drain groove 106*a* may be formed in a substantially rectangular shape at an upper end of the second partition wall 106. The second drain grooves 106*a* may be formed to be spaced apart from each other in the circumferential direction of the second partition wall 106.

The second drain groove 106*a* may be provided in various shapes. According to one embodiment of the present disclosure, the second drain groove 106*a* may have a substantially rectangular shape, but is not limited thereto. For example, the second drain groove 106*a* may be formed in a shape of a circle passing through the second partition wall 106.

The cover portion 110 may form the second drain hole 130 together with the seating portion 105. In detail, the outer horizontal portion 115 may form the second drain hole 130 together with the second drain groove 106*a*. The second partition wall 106 may be arranged to be in contact with the outer horizontal portion 115. When the second partition wall 106 and the outer horizontal part 115 are in contact with each other, the second drain groove 106*a* may form the second drain hole 130. That is, when the cover portion 110 is coupled to the basket portion 102, the cover portion 110 and the seating portion 105 may form the second drain hole 130.

The second drain hole 130 may be located to be higher than the first drain hole 120. In addition, the second drain hole 130 and the first drain hole 120 may be alternately disposed. That is, the first drain hole 120 and the second drain hole 130 may not be arranged successively along a straight line. The second partition wall 106 may be disposed on a rear side of the first drain hole 120, and wash water in the auxiliary washing tub 100 may pass through the first drain hole 120, and then is caused to flow in a space between the first partition wall 118 and the second partition wall 106. The wash water, flowing in the space between the first partition wall 118 and the second partition wall 106, may be introduced into the second drain hole 130.

The outer cover portion 114 may guide the wash water having passed through the second drain hole 130 to the upper side of the balancer 90 together with the seating portion 105. The wash water having passed through the second drain hole 130 may be prevented from escaping to the upper portion the auxiliary washing tub by the outer horizontal portion 115 and may be guided to the upper side of the balancer 90 by the outer bent portion 116. Meanwhile, the seating portion 105 may prevent the wash water from being introduced into the upper side of the main washing tub 30.

The balancer 90 may include an opening 91 allowing laundry to be introduced into the main washing tub 30 therethrough, a supporting rib 93 extending upward along the periphery of the opening 91, and a connecting hole 94.

The support rib 93 may extend upward to be higher than an upper surface 92 of the balancer 90. The support rib 93 may refer to the upper end of the balancer 90. When the balancer 90 is coupled to the main washing tub 30, the supporting rib 93 may refer to the upper end of the main washing tub 30.

The supporting rib 93 may be provided to support the auxiliary washing tub 100. The supporting rib 93 may be fitted into the fitting groove 109*a* of the seating portion 105 to support the auxiliary washing tub 100.

The supporting rib 93 may prevent the wash water guided by the drain path 140 from flowing into the main washing tub 30. Since the supporting rib 93 extends upward to be higher than the upper surface 92 of the balancer 90, and the auxiliary washing tub 100 is seated on the supporting rib 93, the wash water guided to the upper surface 92 of the balancer is prevented from being introduced into the main washing tub 30. That is, since the supporting rib 93 covers the entire area of the opening 91 of the main washing tub 30 together with the auxiliary washing tub 100, the wash water may not flow into the main washing tub 30 through the opening 91.

Hereinafter, the drain process and the drain path of the auxiliary washing tub 100 will be described in detail.

Since the first drain hole 120 is formed on the upper portion of the sidewall 103, when the auxiliary washing tub 100 rotates below a predetermined rotational speed, wash water is not subjected to a centrifugal force and thus does not move to the upper portion of the sidewall 103. Therefore, the wash water in the second washing space 101 is not drained to the outside of the auxiliary washing tub 100.

Wash water in the second washing space 101 is subjected to a centrifugal force and may move to the upper portion of the sidewall 103 along the inclined sidewall 103 when the auxiliary washing tub 100 rotates at the predetermined rotational speed or above. A plurality of the first drain holes 120 may be formed in the upper portion of the sidewall 103 and the wash water may be introduced into the first drain holes 120. The wash water introduced into the first drain holes 120 may flow along a flow path formed by the first partition wall 118 and the second partition wall 118 and 106 and flow into the second drain hole 130. The wash water having passed through the second drain hole 130 may be guided to the upper side of the balancer 90 by the seating portion 105 and the cover portion 110.

The auxiliary washing tub 100 may include the drain path 140 for guiding the wash water of the second washing space 101 to the space between the tub 20 and the main washing tub 30.

The drain path 140 may be formed by the seating portion 105 and the cover portion 110. The drain path 140 may include the first drain hole 120, the space between the first partition wall 118 and the second partition wall 106, the second drain hole 130, and the space between the horizontal portion 107 and the outer cover portion 114. That is, the drain path 140 may refer to a section from which wash water of the second washing space 101 moved to the upper portion of the sidewall 103 and passing through the first drain hole 120 starts to be guided to the upper side of the balancer 90. The wash water of the second washing space 101 may be guided to the upper side of the balancer 90 by the drain path 140. Since the process of guiding the wash water through the drain path 140 has been described above, the description thereof will be omitted in order to avoid redundancy.

The wash water of the second washing space 101 may be guided to the upper surface 92 of the balancer by the drain path 140 as described above. The wash water guided to the upper surface 92 of the balancer may not be introduced into the main washing tub 30 due to the supporting rib 93, but is moved to the outside of the main washing tub 30 due to a centrifugal force when the main washing tub 30 rotates. The wash water moved to the outside of the main washing tub 30 may be guided to the space between the main washing tub 30 and the tub 20. The wash water guided to the space between the main washing tub 30 and the tub 20 may be drained to the outside of the cabinet 10 through the drain hose 70.

Figure 7:
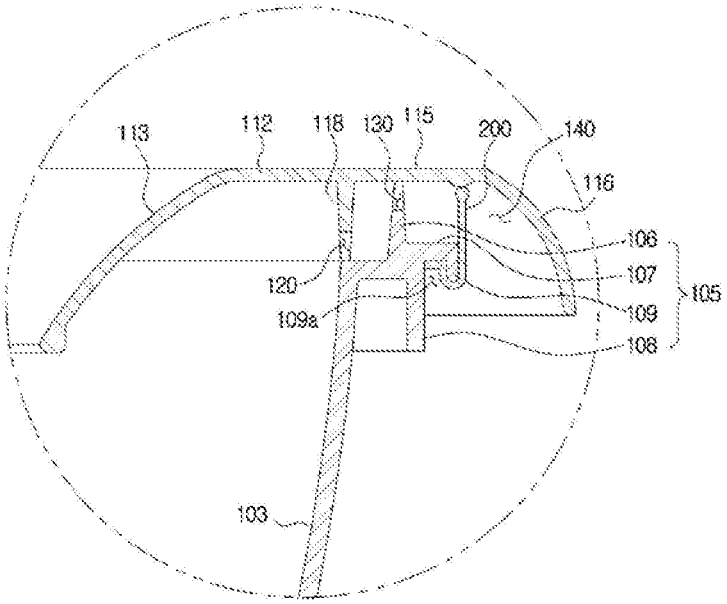
FIGS. 7 and 8 are views illustrating a drain path opening and closing member of the washing machine according to the embodiment of the present disclosure.
Figure 8:
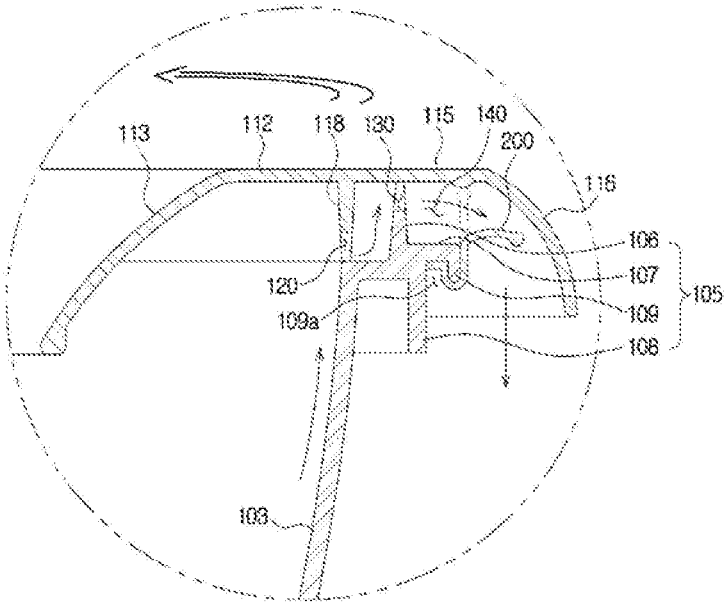

FIGS. 7 and 8 are views illustrating a drain path opening and closing member of the washing machine according to the embodiment of the present disclosure.

Referring to FIGS. 7 and 8, the auxiliary washing tub 100 may further include a drain path opening and closing member 200 for opening or closing the drain path 140 depending on the rotational speed of the auxiliary washing tub 100.

The drain path opening and closing member 200 may close the drain path 140 when the auxiliary washing tub 100 rotates below a predetermined rotational speed. Accordingly, the wash water may be prevented from being drained through the drain path 140 in a washing process in which drain is not desired.

The drain path opening and closing member 200 may open the drain path 140 when the auxiliary washing tub 100 rotates at the predetermined rotational speed or above. Therefore, in a dehydrating process, the wash water may be drained to the outside of the auxiliary washing tub 100 through the drain path 140.

The drain path opening and closing member 200 may be formed of a deformable material, e.g., rubber or silicone. When the auxiliary washing tub 100 rotates at a predetermined rotational speed or above, the drain path opening and closing member 200 is subjected to a centrifugal force, and may be deformed by the centrifugal force. The drain path opening and closing member 200 may be provided to close the drain path 140 upon receiving no centrifugal force, and may be provided to open the drain path 140 when the drain path opening and closing member 200 is deformed.

The drain path opening and closing member 200 may be coupled to the seating portion 105. According to an embodiment of the present disclosure, the drain path opening and closing member 200 may have at least a portion thereof fitted into the fitting groove 109*a*. Since the fitting grooves 109*a* are formed along the periphery of the basket portion 102, the drain path opening and closing member 200 may be provided in a ring shape having an opening.

The auxiliary washing tub 100 may further include a drain hole opening and closing member for opening or closing the drain hole depending on the rotational speed of the auxiliary washing tub 100.

Figure 9:
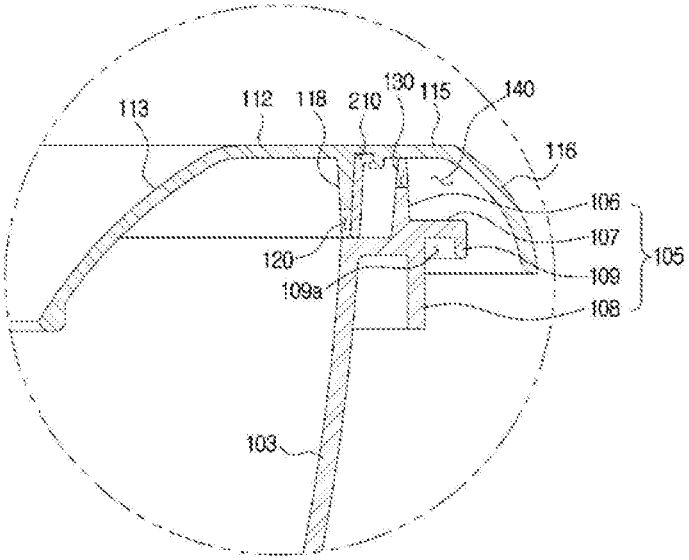
FIGS. 9 and 10 are views illustrating a drain hole opening and closing member of the washing machine according to the embodiment of the present disclosure.
Figure 10:
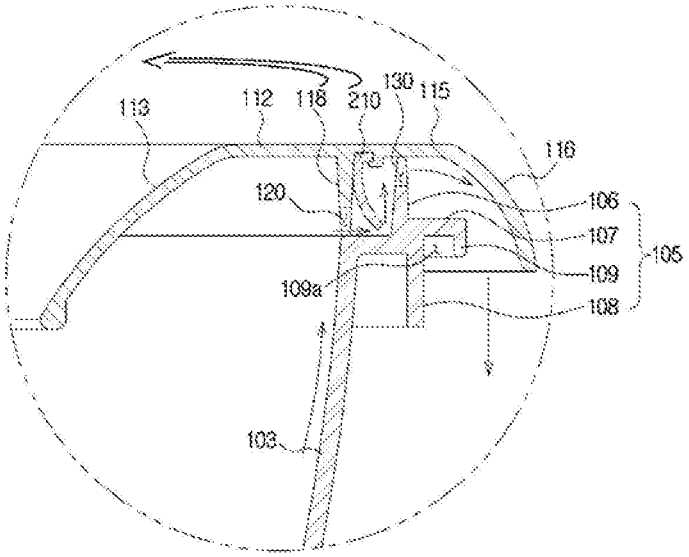

FIGS. 9 and 10 are views illustrating a drain hole opening and closing member of the washing machine according to the embodiment of the present disclosure.

Referring to FIGS. 9 and 10, according to the embodiment of the present disclosure, a drain hole opening and closing member 210 may open and close the first drain hole 120.

The drain hole opening and closing member 210 may close the first drain hole 120 when the auxiliary washing tub 100 rotates below a predetermined rotational speed. Therefore, the wash water may be prevented from being drained to the outside of the auxiliary washing tub 100 through the first drain hole 120 in the washing process.

The drain hole opening and closing member 210 may open the first drain hole 120 when the auxiliary washing tub 100 rotates at the predetermined rotational speed or above. Therefore, in the dehydrating process, the wash water may be drained to the outside of the auxiliary washing tub 100 through the drain path 140.

The drain hole opening and closing member 210 may be formed of a deformable material similar to the drain path opening and closing member 200. Description of the drain hole opening and closing member 210 identical to that of the drain path opening and closing member 200 will be omitted.

The drain hole opening and closing member 210 may be disposed between the first partition wall 118 and the second partition wall 106. According to the embodiment of the present disclosure, the cover portion 110 may be provided with a groove into which the drain hole opening and closing member 210 is fitted, and the drain hole opening and closing member 210 may be fitted to the groove. The drain hole opening and closing members 210 may be provided corresponding in number to the number of the first drain holes 120. Alternatively, the drain hole opening and closing member 210 may be provided as a single member. In this case, the drain hole opening and closing member 210 may be formed in a ring shape along the first partition wall 118.

Figure 11:
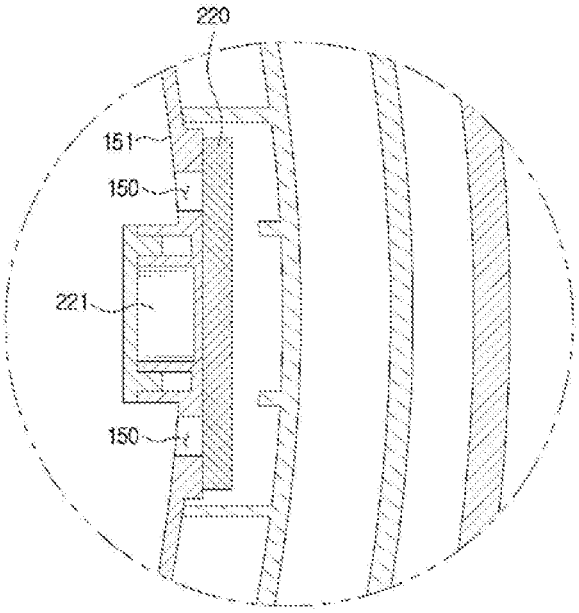
FIGS. 11 to 13 are views illustrating a drain hole opening and closing member of a washing machine according to another embodiment of the present disclosure.
Figure 12:
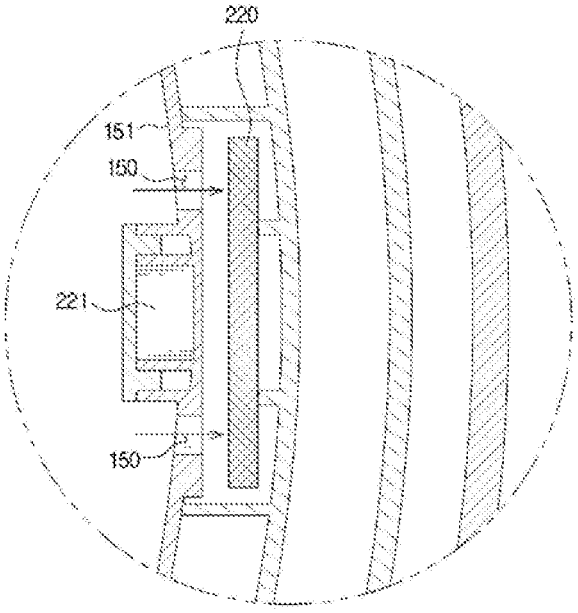
Figure 13:
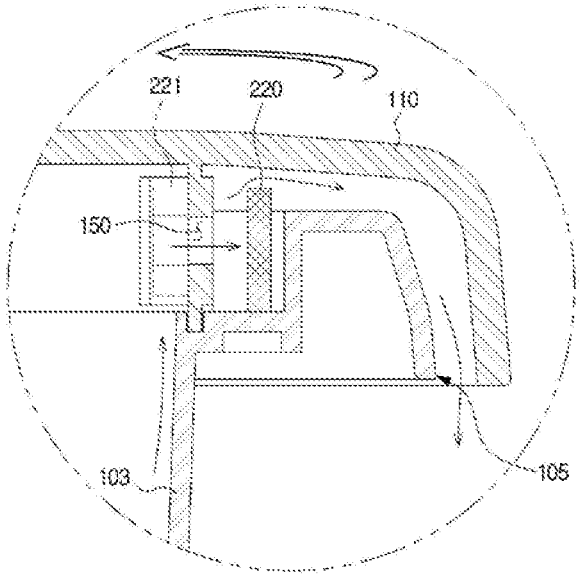

FIGS. 11 to 13 are views illustrating a drain hole opening and closing member of a washing machine according to another embodiment of the present disclosure.

Referring to FIGS. 11 to 13, according to the embodiment of the present disclosure, the auxiliary washing tub 100 may include a drain hole 150. The drain hole 150 may be formed through a partition wall 151 extending downward from the cover portion 110. A drain hole opening and closing member 220 formed of a metal may be disposed on one side of the partition wall 151, and a magnet 221 may be disposed on the other side of the partition wall 151. Alternatively, the drain hole opening and closing member may be formed of a magnet, and a metal member may be provided instead of a magnet.

The drain hole opening and closing member 220 may be disposed to make contact with the partition wall 151 by a magnetic force with the magnet 221. In this case, the drain hole opening and closing member 220 may be disposed to cover the drain hole 150, and the drain hole 150 may be closed.

When the auxiliary washing tub 100 rotates below a predetermined rotational speed, the centrifugal force may be weaker than the magnetic force between the drain hole opening and closing member 220 and the magnet 221 to thereby close the drain hole 150.

When the auxiliary washing tub 100 rotates at the predetermined rotational speed or above, the centrifugal force may be stronger than the magnetic force between the drain hole opening and closing member 220 and the magnet 221. The drain hole opening and closing member 220 is separated from the partition wall 151 by the centrifugal force, and the drain hole 150 is opened.

Through this process, the drain hole opening and closing member 220 closes the drain hole 150 in the washing process, and the drain hole opening and closing member 220 opens the drain hole 150 in the dehydrating process.

Figure 14:
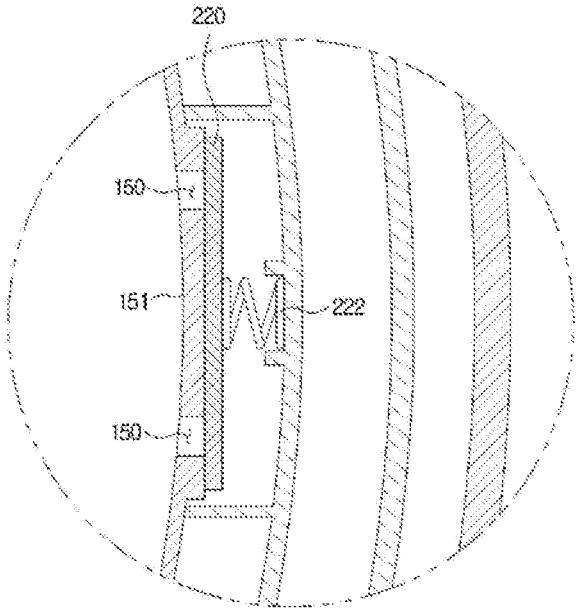
FIGS. 14 and 15 are views illustrating a drain hole opening and closing member of a washing machine according to still another embodiment of the present disclosure.
Figure 15:
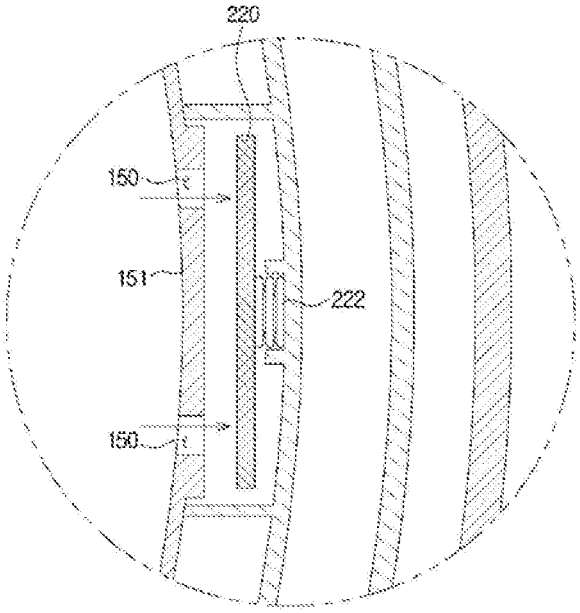

FIGS. 14 and 15 are views illustrating a drain hole opening and closing member of a washing machine according to still another embodiment of the present disclosure.

Referring to FIGS. 14 and 15, according to the embodiment of the present disclosure, a drain hole opening and closing member 220 may include an elastic member 222.

The drain hole opening and closing member 220 may be coupled to the elastic member 222. The elastic member 222 may provide an elastic force such that the drain hole opening and closing member 220 makes contact with the partition wall 151 in which the drain hole 150 is formed.

When the auxiliary washing tub 100 rotates below a predetermined rotational speed, the centrifugal force may be smaller than the elastic force of the elastic member 222 acting on the drain hole opening and closing member 220. In this case, the drain hole opening and closing member 220 may close the drain hole 150.

When the auxiliary washing tub 100 rotates at the predetermined rotational speed or above, the centrifugal force may be larger than the elastic force of the elastic member 222 acting on the drain hole opening and closing member 220. In this case, the drain hole opening and closing member 220 may open the drain hole 150.

Through this process, the drain hole opening and closing member 220 closes the drain hole 150 in the washing process in which the rotational speed of the auxiliary washing tub 100 is relatively slow, and the drain hole opening and closing member 220 may open the drain hole 150 in the dehydrating process in which the rotational speed of the auxiliary washing tub 100 is relatively fast.

Although exemplary embodiments of the present disclosure have been described for illustrative purposes, those skilled in the art will appreciate that various modifications, additions and substitutions are possible, without departing from the scope and spirit of the disclosure. Therefore, exemplary embodiments of the present disclosure have not been described for limiting purposes.

The invention claimed is:

1. A washing machine comprising:

a cabinet;

a tub located in the cabinet and storing wash water therein;

a main washing tub rotatably disposed in the tub and having a first washing space; and an auxiliary washing tub detachably mounted to the main washing tub and having a second washing space, wherein the auxiliary washing tub includes a drain path for guiding wash water of the second washing space to a space between the tub and the main washing tub, wherein the auxiliary washing tub includes:

a basket portion including a bottom wall, a sidewall extending upward from the bottom wall to form the second washing space, and a seating portion radially outwardly extending from the sidewall to be seated on an upper side of the main washing tub, and a cover portion provided at an upper side of the basket portion and having a laundry inlet, wherein the cover portion includes a first partition wall extending downwardly toward the sidewall and having a first drain groove, the first partition wall forms a first drain hole together with the sidewall, and wherein the seating portion includes a second partition wall extending upwardly toward the cover portion and having a second drain groove, the second partition wall forms a second drain hole together with the cover portion.

2. The washing machine of claim 1, wherein the drain path is formed by the seating portion and the cover portion.

3. The washing machine of claim 1, wherein the first drain hole and the second drain hole are located to be higher than an upper end of the main washing tub.

4. The washing machine of claim 1, wherein the cover portion further includes an inner cover portion that guides wash water in the basket portion to the first drain hole and an outer cover portion that guides wash water having passed through the first drain hole and the second drain hole to an outside of the main washing tub together with the seating portion.

5. The washing machine of claim 4, wherein the inner cover portion extends toward an inside of the basket portion, and the outer cover portion extends toward an outside of the basket portion and is bent downward.

6. The washing machine of claim 1, wherein wash water in the auxiliary washing tub is introduced into the first drain hole along the sidewall when the auxiliary washing tub rotates at a predetermined rotational speed or above, and the wash water introduced into the first drain hole is introduced into the second drain hole by the first partition wall and the second partition wall, and the wash water introduced into the second drain hole is guided to the outside of the main washing tub by the seating portion and the cover portion.

7. The washing machine of claim 1, wherein the auxiliary washing tub is formed of deformable material, has a ring shape, and further includes a drain path opening and closing member to open or close the drain path depending on a rotational speed of the auxiliary washing tub.

* * * * *